US008272641B2

(12) United States Patent
Tokoro

(10) Patent No.: US 8,272,641 B2
(45) Date of Patent: Sep. 25, 2012

(54) IMAGE FORMING APPARATUS

(75) Inventor: Yuji Tokoro, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 146 days.

(21) Appl. No.: 12/732,891

(22) Filed: Mar. 26, 2010

(65) Prior Publication Data

US 2011/0024965 A1 Feb. 3, 2011

(30) Foreign Application Priority Data

Jul. 31, 2009 (JP) ..... 2009-178664
Feb. 10, 2010 (JP) ..... 2010-027223

(51) Int. Cl.
*B65H 5/34* (2006.01)

(52) U.S. Cl. ..... 271/270; 271/225; 271/301
(58) Field of Classification Search ..... 271/225, 271/270, 301, 304, 291
See application file for complete search history.

(56) References Cited

U.S. PATENT DOCUMENTS

| | | | | |
|---|---|---|---|---|
| 2005/0251286 | A1* | 11/2005 | Yasui | 700/230 |
| 2006/0202407 | A1* | 9/2006 | Yasui et al. | 271/226 |
| 2007/0040325 | A1* | 2/2007 | Matsumoto et al. | 271/186 |
| 2010/0129094 | A1 | 5/2010 | Maeda et al. | |

FOREIGN PATENT DOCUMENTS

| | | | |
|---|---|---|---|
| JP | 11-334966 | | 12/1999 |
| JP | 2001-240269 | | 9/2001 |
| JP | 2002-030480 | | 1/2002 |
| JP | 2002-278186 | A | 9/2002 |
| JP | 2002-284396 | A | 10/2002 |
| JP | 2003-050528 | | 2/2003 |
| JP | 2004-299894 | A | 10/2004 |
| JP | 2007-065535 | A | 3/2007 |
| JP | 2008-276014 | A | 11/2008 |
| JP | 2009-046303 | A | 3/2009 |

OTHER PUBLICATIONS

JP Office Action dtd May 24, 2011, JP Appin. 2010-027223, English translation.

* cited by examiner

*Primary Examiner* — Michael McCullough
*Assistant Examiner* — Howard Sanders
(74) *Attorney, Agent, or Firm* — Banner & Witcoff, Ltd.

(57) ABSTRACT

A laser printer is equipped with first to fourth motors, and controls independently first to fourth driving portions, respectively. The laser printer does a continuous double-side printing for a preceding paper and a following paper. When the preceding paper on a first surface of which the printing is applied is conveyed to a predetermined position, the laser printer feeds the following paper. When the preceding paper exceeds a sensing range of a paper sensor, the laser printer conveys the preceding paper at a high-speed re-conveyance velocity in a switchback mode. When the feeding of the following paper is done normally, the laser printer conveys the preceding paper to a re-conveyance path while lowering the conveyance velocity to a normal re-conveyance velocity. When an error occurs in the feeding of the following paper, the laser printer stops the conveyance of the preceding paper in the switchback mode.

6 Claims, 10 Drawing Sheets

IMAGE FORMING APPARATUS

CROSS REFERENCE TO RELATED APPLICATION

The present application claims priority from Japanese Patent Applications No. 2009-178664, which was filed on Jul. 31, 2009 and No. 2010-027223, which was filed on Feb. 10, 2010, the disclosure of which is incorporated herein by reference in its entirety.

BACKGROUND OF THE INVENTION

The present invention relates to an image forming apparatus capable of doing the double-side printing by which the printing is applied to both the front and back surfaces of a recording sheet.

In the related art, various inventions of the image forming apparatus that is capable of doing the double-side printing have been made. Such image forming apparatus applies the desired printing to both the front and back surfaces of one recording sheet respectively. Also, a speedup of the double-side printing (i.e., shortening of a required time for the double-side printing) is demanded in the image forming apparatus that can do the double-side printing.

The related image forming apparatus does the printing on the front surface of one paper, and then does the printing on the back surface of the same paper. Then, when the double-side printing is to be applied to the next paper, the image forming apparatus applies the printing in order to the front surface and the back surface of the second paper. Then, in the conveyance period except a period in which the printing is applied to one paper (the recording sheet) (referred to as a "printing period" hereinafter), the related image forming apparatus conveys the paper at a higher conveyance velocity than the conveyance velocity of the paper during the printing period. Accordingly, the related image forming apparatus can shorten a required time for the double-side printing on one paper, and thus implement the speedup of the double-side printing.

However, the related image forming apparatus can realize the speedup of the double-side printing on one paper, nevertheless such apparatus cannot do the double-side printing on the next paper even after the double-side printing on one paper is completed. That is, this image forming apparatus has room for improvement in shortening of the required period when the double-side printing is applied continuously to plural sheets of paper.

Here, as the system for the double-side printing in the image forming apparatus, there is the system that applies the double-side printing continuously to plural sheets of paper at the same time. Specifically, the image forming apparatus employing this system does the printing on the back surface of the first paper and then does the printing on the back surface of the second paper, and then does the printing in order on the front surface of the first paper and the front surface of the second paper.

The image forming apparatus employing this system conveys the first paper along with the conveyance path such that the printing on the front surface of the first paper can be done while the printing on the back surface of the second paper is applied. That is, both the first paper and the second paper exist simultaneously on the conveyance path of this image forming apparatus. Therefore, when the above-mentioned technology is applied to the image forming apparatus of this system, it is feared that a high-speed feed of one paper in a conveyance period causes a trouble for the printing and the conveyance to the other paper (for example, a collision with the other paper, or the like).

The present invention provides an image forming apparatus for making a high-speed processing possible while keeping a quality of printed results of a double-side printing in a system that the double-side printing is applied continuously at the same time to plural sheets of paper.

To achieve the object of the present invention, the exemplary embodiment of the invention provides an image forming apparatus capable of performing single-side and double-side printing on a recording sheet, comprising:

a conveyance path;

an image forming unit which forms an image on the recording sheet which are passing through the conveyance path;

a fixing unit which fixes the image being formed by the image forming unit on the recording sheet;

a backward conveyance path which guides the recording sheet, in which the image formed on one surface thereof, toward the image forming unit to form the image on the other surface of the recording sheet;

a feeder which feeds the recording sheet at a timing at which a predetermined interval is formed between the plural recording sheets respectively such that the recording sheets are present on the conveyance path and/or the backward conveyance, when a printing is carried out on the recording sheet;

a first conveyance unit which conveys the recording sheet selectively in an eject mode or in a switchback conveyance mode, wherein in the eject mode, the recording sheet on which the image is fixed is ejected to an outside of the apparatus on a downstream side of the fixing unit in a conveyance direction of the recording sheet, and wherein in the switchback conveyance mode, the conveyance direction of the recording sheet in which the image is formed on one surface thereof is switched backward on the downstream side of the fixing unit and then the recording sheet is conveyed toward the backward conveyance path;

a first driver which drives the first conveyance unit;

a second conveyance unit which conveys the recording sheet, which is conveyed by the first conveyance unit in the switchback conveyance mode toward the backward conveyance path, to the image forming unit through the backward conveyance path;

a second driver which drives the second conveyance unit; and a drive controller which controls the first driver such that a conveyance velocity at which the recording sheet is conveyed in the switchback conveyance mode is higher than a conveyance velocity at which the recording sheet at which the recording sheet is conveyed in the eject mode, and controls the first driver such that, in the switchback conveyance mode, the recording sheet is conveyed while lowering the conveyance velocity of the recording sheet in response to a conveyance velocity of the recording sheet conveyed by the second conveyance unit, before the recording sheet reaches the second conveyance unit.

DESCRIPTION OF EXEMPLARY EMBODIMENTS

Figure 1:
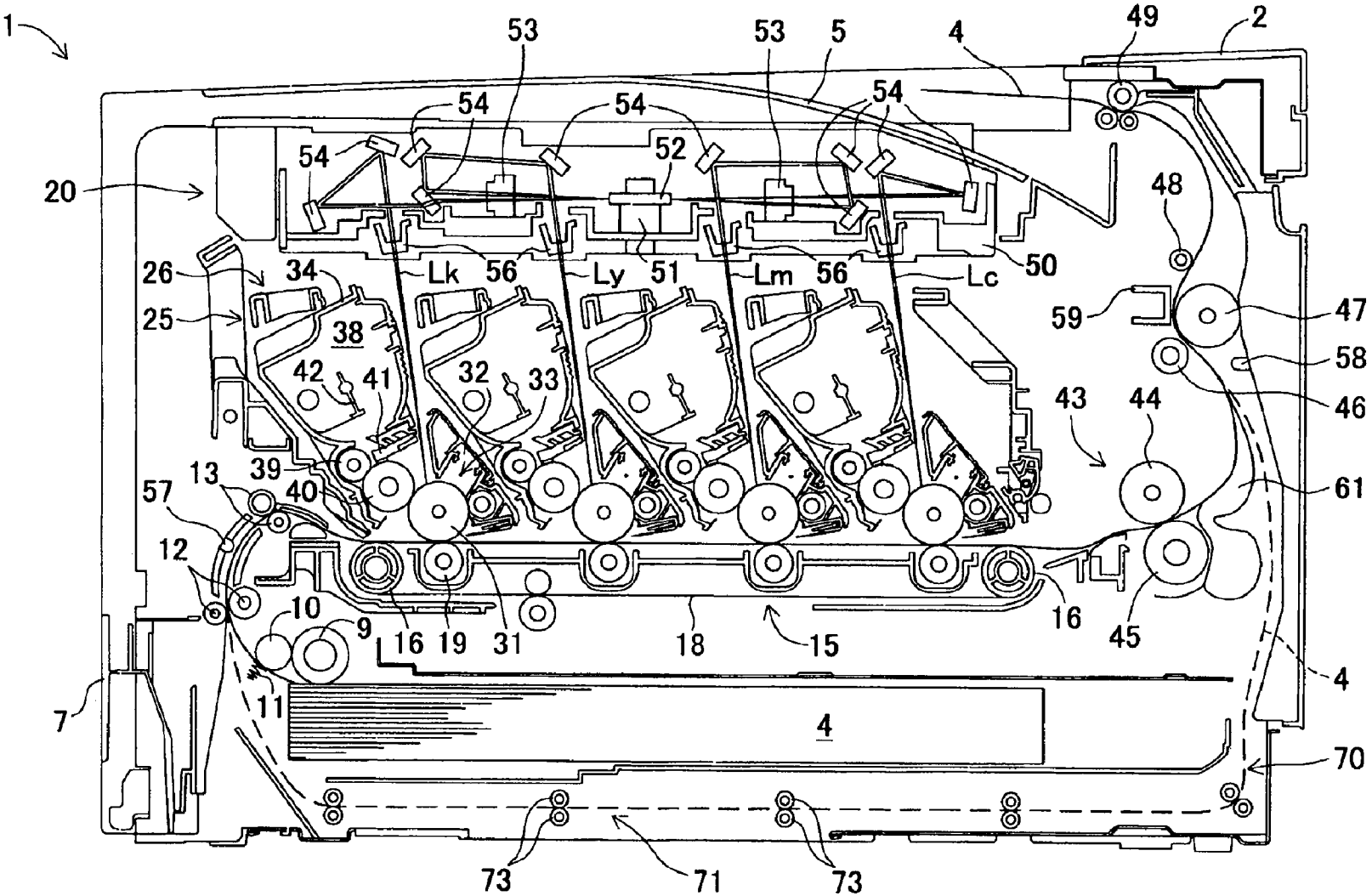
FIG. 1 is an explanatory view showing a schematic configuration of a laser printer according to an embodiment of the present invention.

An embodiment in which an image forming apparatus according to the present invention is embodied as a laser printer 1 will be explained in detail with reference to the drawings hereinafter. In the following explanation, the left side in FIG. 1 is assumed as the front side (front of the apparatus).

The laser printer 1 according to the exemplary embodiment is a color laser printer of direct transfer tandem system. As shown in FIG. 1, the laser printer 1 includes an almost box-type main body casing 2. The main body casing 2 is equipped with a paper eject tray 5 on the top surface of the main body casing 2. The paper eject tray 5 contains respective papers 4 ejected from the inside of the main body casing 2 in a stacked state. The paper 4 is the recording sheet for the laser printer 1.

Then, the main body casing 2 has a paper feed cassette 7 at the bottom of the main body casing 2. The paper feed cassette 7 loads the papers 4, which are stacked prior to the image formation in the laser printer 1, thereon. The paper feed cassette 7 is fitted to the bottom of the main body casing 2 such that this cassette can be pulled forwardly.

A paper feed roller 9, a separate roller 10, and a separate pad 11 are provided in the front upper position of the paper feed cassette 7. The paper feed roller 9 feeds the paper, which is contained in the paper feed cassette 7, from the paper feed cassette 7. The separate roller 10 and the separate pad 11 are provided on the downstream side in the paper conveyance direction of the paper feed roller 9. The separate roller 10 and the separate pad 11 separate the papers 4 being conveyed by the paper feed roller 9 every sheet.

A sheet of paper 4 that is separated by the separate roller 10 and the separate pad 11 is conveyed to register rollers 13 by a pair of conveyance rollers 12. The register rollers 13 feed the conveyed paper 4 to a belt unit 15 at predetermined timings. In this case, "predetermined timings" used in the case where the double-side printing is done continuously on plural sheets of paper 4 (referred to as the "continuous double-side printing" hereinafter) denote the timings between which an interval between a rear end of a preceding paper 4A and a front end of a following paper 4B constitutes a predetermined interval.

A paper feed sensor 57 is provided on the conveyance path of the paper 4 from the separate roller 10 to the register rollers 13. This paper feed sensor 57 senses whether or not the feeding of the paper 4 from the paper feed cassette 7 is normally executed.

The belt unit 15 is constructed by a pair of belt support rollers 16, a conveyance belt 18, and four transfer rollers 19. The belt unit 15 is constructed such that this unit can be detachably attached to the main body casing 2. The belt support rollers 16 are provided to the inside of the main body casing 2 at a distance in the longitudinal direction.

The conveyance belt 18 is stretched horizontally between a pair of belt support rollers 16. The conveyance belt 18 is the endless belt made of a resin material such as polycarbonate, or the like. The conveyance belt 18 is circulated/moved in the predetermined direction (in FIG. 1, the clockwise direction) when the belt support rollers 16 are rotated/driven. Therefore, the paper 4 put on the conveyance belt 18 is conveyed to the backward of the main body casing 2.

As shown in FIG. 1, four transfer rollers 19 are aligned at a predetermined interval along the longitudinal direction of the main body casing 2 on the inner side of the conveyance belt 18. Respective transfer rollers 19 are arranged to oppose to photosensitive drums 31 constituting the image forming units (i.e., a first image forming unit 26*k* to a fourth image forming unit 26*c*), described later, via the conveyance belt 18. Since respective transfer rollers 19 come into contact with the inner surface of the conveyance belt 18, these rollers are rotated in accordance with the circulation/movement of the conveyance belt 18.

The main body casing 2 contains the belt unit 15, a scanner unit 20, and a processing portion 25 therein. The scanner unit 20 is provided to the top portion in the main body casing 2. The scanner unit 20 irradiates a laser light in colors of black (K), cyan (C), magenta (M), and yellow (Y) respectively, based on predetermined image data. The scanner unit 20 guides the laser light corresponding to each color onto a surface of the photosensitive drum 31 corresponding to each color, and scans the surface of the photosensitive drum 31 at a high speed. A configuration of the scanner unit 20 will be explained in detail later.

Figure 3:
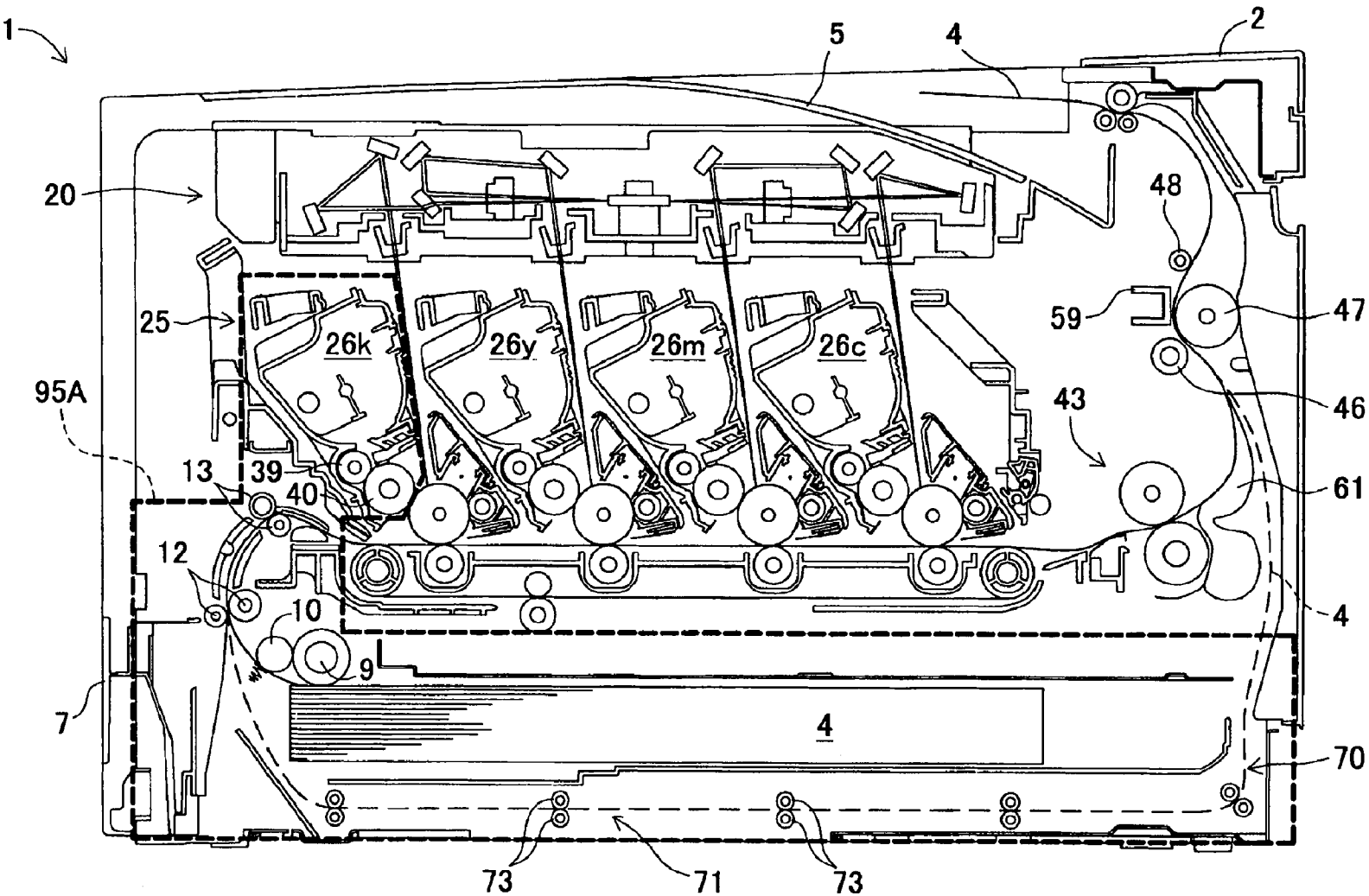
FIG. 3 is an explanatory view showing a first drive-target area in the laser printer.

The processing portion 25 is provided below the scanner unit 20 but over the belt unit 15 (see FIG. 1). As shown in FIG. 3, and the like, the processing portion 25 is equipped with the first image forming unit 26*k*, the second image forming unit 26*y*, the third image forming unit 26*m*, and the fourth image forming unit 26*c*. Four image forming units 26 are aligned from the front side to the rear side of the laser printer 1 in order of the first image forming unit 26*k* to the fourth image forming unit 26*c*.

The first image forming unit 26*k* is used in the image formation corresponding to the color of black (K). The second image forming unit 26*y* is used in the image formation corresponding to the color of yellow (Y). The third image forming unit 26*m* is used in the image formation corresponding to the color of magenta (M). The fourth image forming unit 26*c* is used in the image formation corresponding to the color of cyan (C). In this case, respective image forming units 26 have the same configuration except the corresponding color (toner).

As shown in FIG. 1, each of the image forming units 26 is constructed to include the photosensitive drum 31, a charging unit 32, a developing cartridge 34, and the like. The photosensitive drum 31 has a drum main body that is made of metal and is grounded, and is constructed by coating a surface layer of the drum main body with a positively chargeable photosensitive layer. The photosensitive layer is formed of polycarbonate, or the like.

The charging unit 32 is arranged in the obliquely upper position on the rear side of the photosensitive drum 31 to oppose to the photosensitive drum 31 at a predetermined interval from the surface of the photosensitive drum 31. The charging unit 32 is the so-called scorotron-type charging unit. The charging unit 32 has a charging wire 33 made of tungsten, or the like. Therefore, the charging unit 32 can charge the surface of the photosensitive drum 31 uniformly at a positive polarity by generating a corona discharge from the charging wire 33.

Each of the developing cartridges 34 is formed like a box shape, and has a toner container 38, a supply roller 39, a develop roller 40, and a layer-thickness regulating blade 41. The toner container 38 is formed in the upper area of the interior of the developing cartridge 34. Each toner container 38 contains the one component toner that the positively chargeable non-magnetism in one color (i.e., any one of black, cyan, magenta, and yellow) corresponding to the image forming unit 26. Each toner container 38 has an agitator 42. The agitator 42 agitates the toner contained in the toner container 38.

The supply roller 39, the develop roller 40, and the layer-thickness regulating blade 41 are arranged in the lower portion of the developing cartridge 34. The supply roller 39 is constructed by coating a metal roller shaft with a conductive foam material. The develop roller 40 is constructed by coating the metal roller shaft with conductive rubber material.

As shown in FIG. 1, the toner as the recording member is discharged from the toner container 38, and then is fed to the develop roller 40 by the rotation of the supply roller 39. At this time, the toner is frictionally charged positively between the supply roller 39 and the develop roller 40. The toner, when is fed to the develop roller 40, enters into an area between the layer-thickness regulating blade 41 and the develop roller 40 according to the rotation of the develop roller 40. At this time, the toner is frictionally charged fully, and then is borne on the develop roller 40 as a thin layer of a predetermined thickness.

Meanwhile, first the surface of the photosensitive drum 31 is positively charged uniformly by the charging unit 32 during the rotation of the photosensitive drum 31. Then, the surface of the photosensitive drum 31 is exposed to the laser light irradiated from the scanner unit 20 by means of the high-speed scanning. As a result, an electrostatic latent image corresponding to the image that is to be formed on the paper 4 is formed on the surface of the photosensitive drum 31.

As described above, the toner that is borne on the develop roller 40 is charged positively. Therefore, the toner is fed to the electrostatic latent image on the surface of the photosensitive drum 31 at a time when the toner is opposed to and comes into contact with the photosensitive drum 31 according to the rotation of the develop roller 40. The fed toner adheres only onto the exposed portion of the photosensitive drum 31 to form a toner image. That is, the toner image is borne on the surface of the photosensitive drum 31. As a result, the electrostatic latent image on the photosensitive drum 31 is rendered visible.

Then, while the paper 4 is passed through an area between the photosensitive drum 31 and the transfer rollers 19 by the conveyance belt 18, the toner images that are borne on the surfaces of respective photosensitive drums 31 are transferred sequentially onto the paper 4 by a transfer bias of negative polarity, which is applied to the transfer rollers 19 under the constant current control. As shown in FIG. 1, the paper 4 onto which the toner images that are transferred are conveyed to a fixing unit 43 that is provided on the rear side of the main body casing 2.

The fixing unit 43 is arranged at the back of the conveyance belt 18 in the main body casing 2 (see FIG. 1). The fixing unit 43 consists of a heat roller 44 and a pressure roller 45. The heat roller 44 has a heat source such as a halogen lamp, or the like, and is provided rotatably. The pressure roller 45 is arranged under the heat roller 44 to oppose thereto, and is brought into contact with the heat roller 44 to push it. The pressure roller 45 is driven/rotated according to the rotation of the heat roller 44. That is, the fixing unit 43 holds/conveys the paper 4 by the heat roller 44 and the pressure roller 45 while heating the paper 4 that bears the four-color toner images. As a result, the fixing unit 43 can thermally fix the toner images on the paper 4 onto the paper 4.

As shown in FIG. 1, a guiding member 61 is provided at the back of the fixing unit 43. The guiding member 61 has a curved guide surface that is protruded backward, and changes the conveyance direction of the paper, on which the toner images are thermally fixed, to a predetermined direction (in FIG. 1, the obliquely upper leftward direction).

Then, an intermediate paper eject roller 46, a paper cool roller 47, and a guide roller 48 are provided over the fixing unit 43. The intermediate paper eject roller 46 is held rotatably in a predetermined position, which is located on the backward side of a shaft of the heat roller 44 and the forward side of the guide surface of the guiding member 61. The paper cool roller 47 is formed of a metal such as aluminum, or the like. This paper cool roller 47 is held rotatably in the obliquely upper backward position with respect to the intermediate paper eject roller 46. In this case, the intermediate paper eject roller 46 and the paper cool roller 47 are constructed rotatably in both forward/backward directions respectively. The guide roller 48 is held rotatably in the position, which is located on the backward side in contrast to the front circumferential surface of the paper cool roller 47, over the intermediate paper eject roller 46 and the paper cool roller 47.

The paper 4 onto which the toner images are thermally fixed is conveyed toward the obliquely upper backward position of the fixing unit 43, and then is conveyed toward the obliquely upper forward position along the guide surface of the guiding member 61. The conveyed paper 4 goes to an area between the intermediate paper eject roller 46 and the paper cool roller 47. Then, the paper 4 is conveyed toward the obliquely upper forward position while being held between the intermediate paper eject roller 46 and the paper cool roller 47. At this time, the curl of the paper 4 is removed because the paper 4 is conveyed while being held between the intermediate paper eject roller 46 and the paper cool roller 47.

Here, as shown in FIG. 1, a guiding piece 59 is formed on the conveyance path of the paper 4 that is conveyed by the paper cool roller 47, and the like. The guiding piece 59 changes the conveyance direction of the paper that is conveyed by the paper cool roller 47, and the like, and guides the paper toward the rear circumferential surface of the guide roller 48. Then, the paper 4 is conveyed toward the paper eject tray 5 while contacting the circumferential surface of the guide roller 48. The guide roller 48 is rotated in accordance with the movement of the paper 4.

Then, as shown in FIG. 1, a paper sensor 58 is provided on the back surface side of the main body casing 2 to face to the conveyance path on the back surface side of the main body casing 2. The paper sensor 58 detects the paper 4 that is conveyed by the intermediate paper eject roller 46, and the like.

As described above, the paper cool roller 47 is formed of a metal whose thermal conductivity is high (for example, aluminum). Thus, this paper cool roller 47 can cool the paper 4 by taking a heat applied by the fixing unit 43 from the paper 4. Because the intermediate paper eject roller 46, the paper cool roller 47, and the guide roller 48 are arranged as shown in FIG. 1, the paper 4 can contact the circumferential surface of the paper cool roller 47 for a longer time. As a result, the laser printer 1 can cool efficiently the paper 4, which underwent the thermal fixing, by the above configuration.

A paper eject roller 49 is provided rotatably at the top of the main body casing 2 on the conveyance path extending from the guide roller 48 to the paper eject tray 5. As shown in FIG. 1, and the like, the paper eject roller 49 opposes to two pinch rollers. Therefore, such paper 4 is put between the paper eject roller 49 and the pinch rollers to remove the curl while the paper 4 is conveyed toward the paper eject tray 5, and then is ejected onto the paper eject tray 5.

In the case where the paper 4 is ejected onto the paper eject tray 5 according to the rotation/drive of the intermediate paper eject roller 46, the paper cool roller 47, and the paper eject roller 49, such paper 4 is ejected onto the paper eject tray 5 at a predetermined conveyance velocity V. That is, the intermediate paper eject roller 46, and the like are driven/controlled in the forward rotation (the rotating direction in which the paper 4 is conveyed onto the paper eject tray 5) such that they eject the paper 4 onto the paper eject tray 5 at the conveyance velocity V. Here, the "conveyance velocity V" denotes a conveyance velocity of the paper 4 when the paper 4 is to be ejected onto the paper eject tray 5.

As shown in FIG. 1, the scanner unit 20 is provided at the top portion of the main body casing 2. The scanner unit 20 has a box-type housing 50 formed of a resin. A polygon mirror 52 with six facets is provided rotatably in the substantially center portion in the housing 50. The polygon mirror 52 is driven by a polygon motor 51. Four laser light sources (not shown) are provided in vicinity of the polygon mirror 52 in the housing 50. Each laser light source irradiates the laser light that corresponds to one color out of black, yellow, magenta, and cyan.

Here, the laser light corresponding to image data in black is referred to as a "laser light Lk", and the laser light corresponding to image data in yellow is referred to as a "laser light Ly". The laser light corresponding to image data in magenta is referred to as a "laser light Lm", and the laser light corresponding to image data in cyan is referred to as a "laser light Lc".

The laser light sources for irradiating the laser light Lk and the laser light Ly are provided to face to one deflecting facet of the polygon mirror 52 respectively. The laser light Lk and the laser light Ly are guided toward the front surface side of the laser printer 1 by one deflecting facet of the polygon mirror 52 respectively, and pass through a first scanning lens 53 (e.g., fθ lens). The laser light Lk and the laser light Ly that passed through the first scanning lens 53 are reflected by a reflecting mirror 54 respectively, and pass through a second scanning lens 56 (e.g., toric lens). Then, the laser light Lk arrives at the surface of the photosensitive drum 31 of the first image forming unit 26*k* corresponding to the black color. The laser light Ly arrives at the surface of the photosensitive drum 31 of the second image forming unit 26*y* corresponding to the yellow color.

The laser light sources for irradiating the laser light Lm and the laser light Lc are provided to face to one deflecting facet of the polygon mirror 52 respectively. One deflecting facet of the polygon mirror 52 is the deflecting facet that is located adjacent to the deflecting facets used for the laser light Lk and the laser light Ly. The laser light Lm and the laser light Lc are guided toward the rear side of the laser printer 1 by one deflecting facet of the polygon mirror 52, and pass through the first scanning lens 53 located on the rear side of the laser printer 1. The laser light Lm and the laser light Lc that passed through the first scanning lens 53 are reflected by the reflecting mirror 54 respectively, and pass through the second scanning lens 56. Then, the laser light Lm arrives at the surface of the photosensitive drum 31 of the third image forming unit 26*m* corresponding to the magenta color. The laser light Lc arrives at the surface of the photosensitive drum 31 of the fourth image forming unit 26*c* corresponding to the cyan color.

As shown in FIG. 1, a re-conveyance mechanism 70 is provided at the bottom portion of the paper feed cassette 7. The re-conveyance mechanism 70 conveys the paper 4 toward the conveyance rollers 12 and the conveyance belt 18 when the paper eject roller 49, the intermediate paper eject roller 46, and the like are rotated backward. That is, in this case, the paper 4 passes through the path indicated with a broken line shown in FIG. 1, and is conveyed toward the conveyance rollers 12 and the conveyance belt 18.

The re-conveyance mechanism 70 has a re-conveyance path 71 that extends along the lower surface of the paper feed cassette 7 in the longitudinal direction. The re-conveyance path 71 conveys the paper 4, which is conveyed downward from the paper eject roller 49 and the intermediate paper eject roller 46, to the forward side of the main body casing 2, and guides the paper 4 to the conveyance rollers 12. Plural sets of re-conveyance rollers 73 are provided rotatably on the re-conveyance path 71. Because the re-conveyance rollers 73 are rotated/driven while contacting the paper 4, the paper 4 is conveyed to the forward side of the main body casing 2.

Since the re-conveyance mechanism 70 is provided, the laser printer 1 can do the so-called double-side printing. More concretely explaining, as described above, the laser printer 1 forms the image on one surface of the paper 4 by the processing portion 25 while conveying the paper 4 by the belt unit 15. The paper 4 on one surface of which the image is formed is conveyed until a rear end of the paper 4 passes through a detection range of the paper sensor 58. When the image is formed on the other surface of the paper 4, the laser printer 1 drives the intermediate paper eject roller 46, the paper eject roller 49, and the like in the backward direction in this state. Accordingly, the paper 4 is pulled into the main body again, and is conveyed to the conveyance rollers 12 by the re-conveyance mechanism 70 via the re-conveyance path 71. When the paper 4 is conveyed to the belt unit 15, the other surface of the paper 4 faces to the processing portion 25 whereas the surface on which the image is formed previously faces to the conveyance belt 18. Therefore, the laser printer 1 can do the double-side printing to form both the front and back surface of the paper 4.

Figure 2:
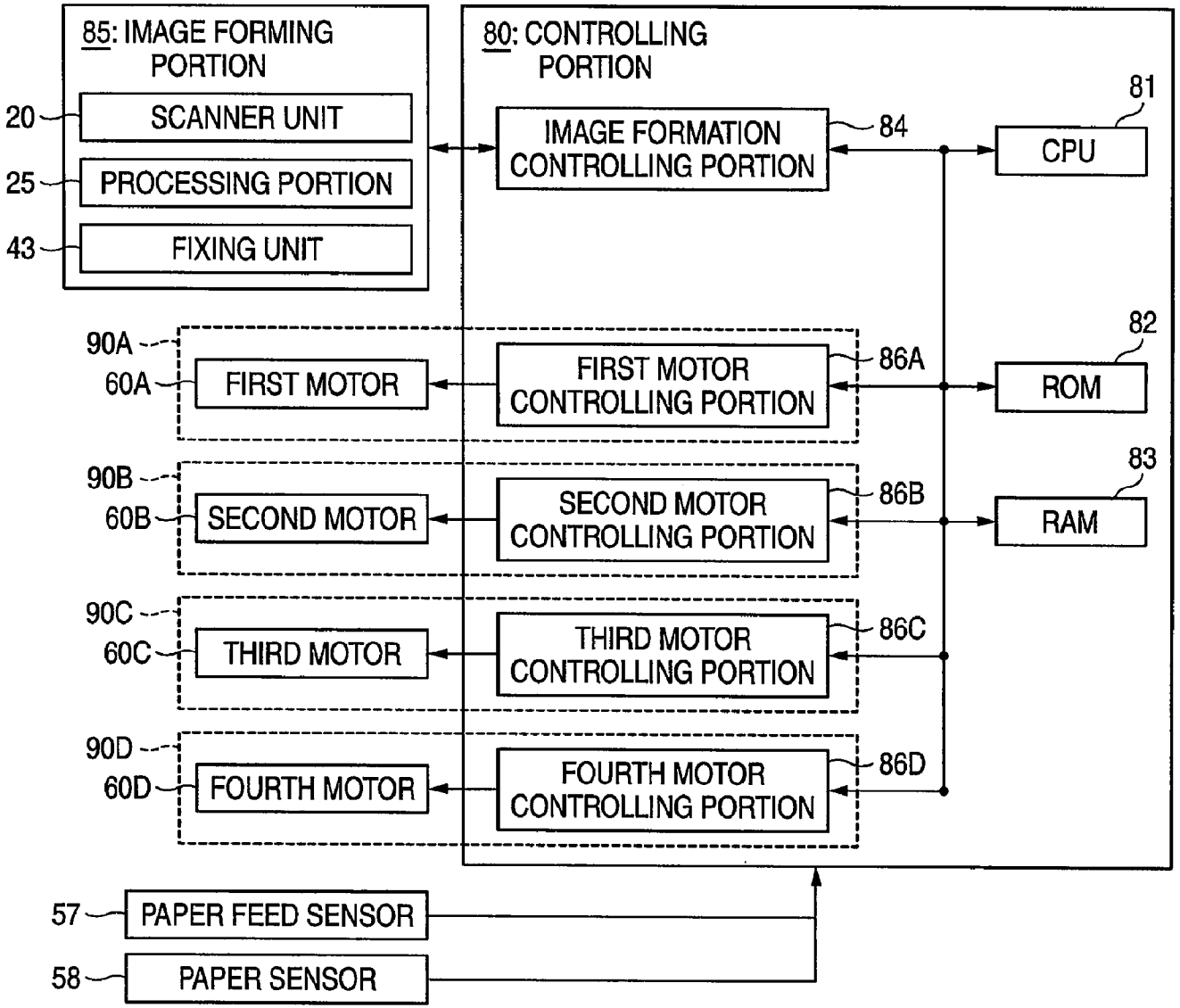
FIG. 2 is a block diagram showing a control system of the laser printer.

Next, a control system of the laser printer 1 according to the exemplary embodiment will be explained hereunder. As shown in FIG. 2, the laser printer 1 includes a controlling portion 80. The controlling portion 80 contains a CPU 81, a ROM 82, and a RAM 83. The CPU 81 denotes the central processing unit that constitutes the nucleus of the control of the laser printer 1, and executes various control programs. The ROM 82 is the memory device that stores various programs, data tables, etc. necessary for the control of the laser printer 1. Therefore, the ROM 82 stores a control program (see FIG. 7) described later. The RAM 83 is the memory device that temporarily stores the calculated results of the CPU 81, etc.

The controlling portion 80 includes an image formation controlling portion 84, a first motor controlling portion 86A, a second motor controlling portion 86B, a third motor controlling portion 86C, and a fourth motor controlling portion 86D. The image formation controlling portion 84 controls an image forming portion 85, based on the control signal from the ROM 82. Here, the image forming portion 85 contains the scanner unit 20, the processing portion 25, and the fixing unit 43. Concretely, the image formation controlling portion 84 executes the exposure control by controlling respective portions constituting the scanner unit 20 to expose the surface of the photosensitive drum 31. The image formation controlling portion 84 executes the control concerning a transfer bias that is applied to transfer the toner to the paper 4 from the photosensitive drum 31.

The first motor controlling portion 86A feeds a drive pulse to a first motor 60A based on the control signal from the CPU 81, and executes the driving control of the first motor 60A. The first motor 60A is one of driving sources in the printing by the laser printer 1, and is constructed by a stepping motor. The first motor controlling portion 86A as well as the first motor 60A constitutes a first driving portion 90A.

The first driving portion 90A corresponds to the driving portion that follows the driving of the first motor 60A, and drives respective portions belonging to a first drive-target area 95A (see FIG. 3). As shown in FIG. 3, the first drive target area 95A contains the paper feed roller 9, the separate roller 10, the conveyance rollers 12, the register rollers 13, the supply roller 39 and the develop roller 40 of the first image forming unit 26*k*, and the re-conveyance rollers 73. Therefore, in the first driving portion 90A, the first motor controlling portion 86A executes respective driving controls of the paper feed roller 9, the separate roller 10, the conveyance rollers 12, the register rollers 13, the supply roller 39 and the develop roller 40 of the first image forming unit 26*k*, and the re-conveyance rollers 73 by executing the driving control of the first motor 60A. If the paper feed roller 9 is driven to feed a new paper 4 from the paper feed cassette 7 while the re-conveyance rollers 73 are driven to convey the paper 4 toward the first image forming unit 26*k*, the paper 4 which is newly fed interferes with the paper which is re-conveyed. To prevent such the interference, at a period in which the re-conveyance rollers 73 are driven to re-convey the paper 4, a clutch mechanism (not shown), such as an electric clutch, for not transmitting the driving power to the paper feeding roller 9 is appropriately provided. In response to a control signal from the CPU 81, the first motor controlling portion 86A controls the drive of the first motor 60 and controls the clutch mechanism. The first motor controlling portion controls the drive timings of each roller such that when the re-conveyance rollers 73 re-conveys the paper 4, the driving power is not transmitted to the paper feeding roller 9 based on a predetermined period so as to smoothly convey the paper within the conveyance path.

The second motor controlling portion 86B feeds a drive pulse to a second motor 60B based on the control signal from the CPU 81, and executes the driving control of the second motor 60B. The second motor 60B is one of driving sources in the printing by the laser printer 1, and is constructed by a stepping motor. The second motor controlling portion 86B as well as the second motor 60B constitutes a second driving portion 90B.

Figure 4:
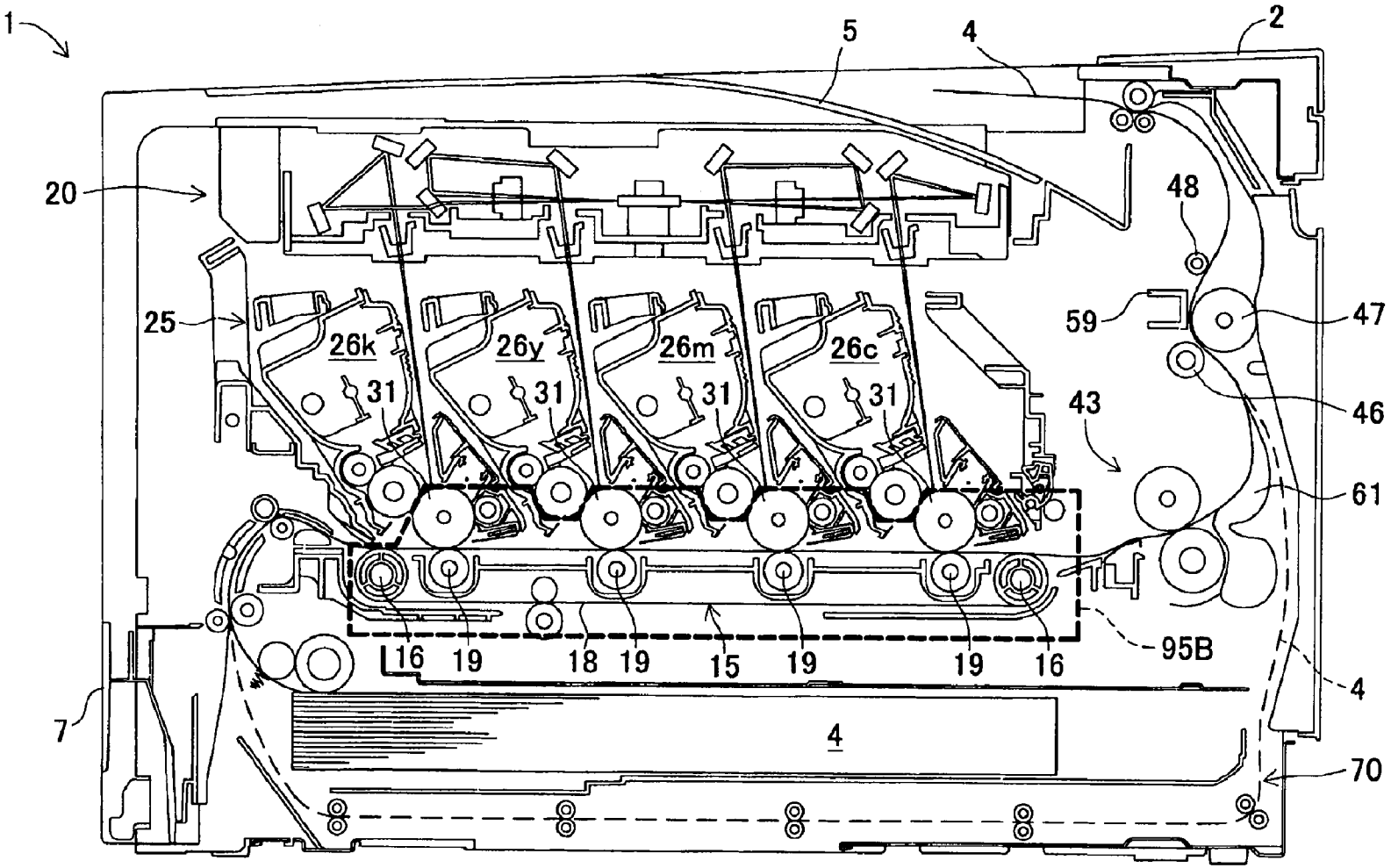
FIG. 4 is an explanatory view showing a second drive-target area in the laser printer.

The second driving portion 90B corresponds to the driving portion that follows the driving of the second motor 60B, and drives respective portions belonging to a second drive-target area 95B (see FIG. 4). As shown in FIG. 4, the second drive target area 95B contains respective photosensitive drums 31 of the first image forming unit 26*k* to the fourth image forming unit 26*c*, and the belt support rollers 16 constituting the belt unit 15. Therefore, in the second driving portion 90B, the second motor controlling portion 86B executes the driving control of respective photosensitive drums 31 of the first image forming unit 26*k* to the fourth image forming unit 26*c*, and the belt support rollers 16 constituting the belt unit 15 by executing the driving control of the second motor 60B.

The third motor controlling portion 86C feeds a drive pulse to a third motor 60C based on the control signal from the CPU 81, and executes the driving control of the third motor 60C. The third motor 60C is one of driving sources in the printing by the laser printer 1, and is constructed by a stepping motor. The third motor controlling portion 86C as well as the third motor 60C constitutes a third driving portion 90C.

Figure 5:
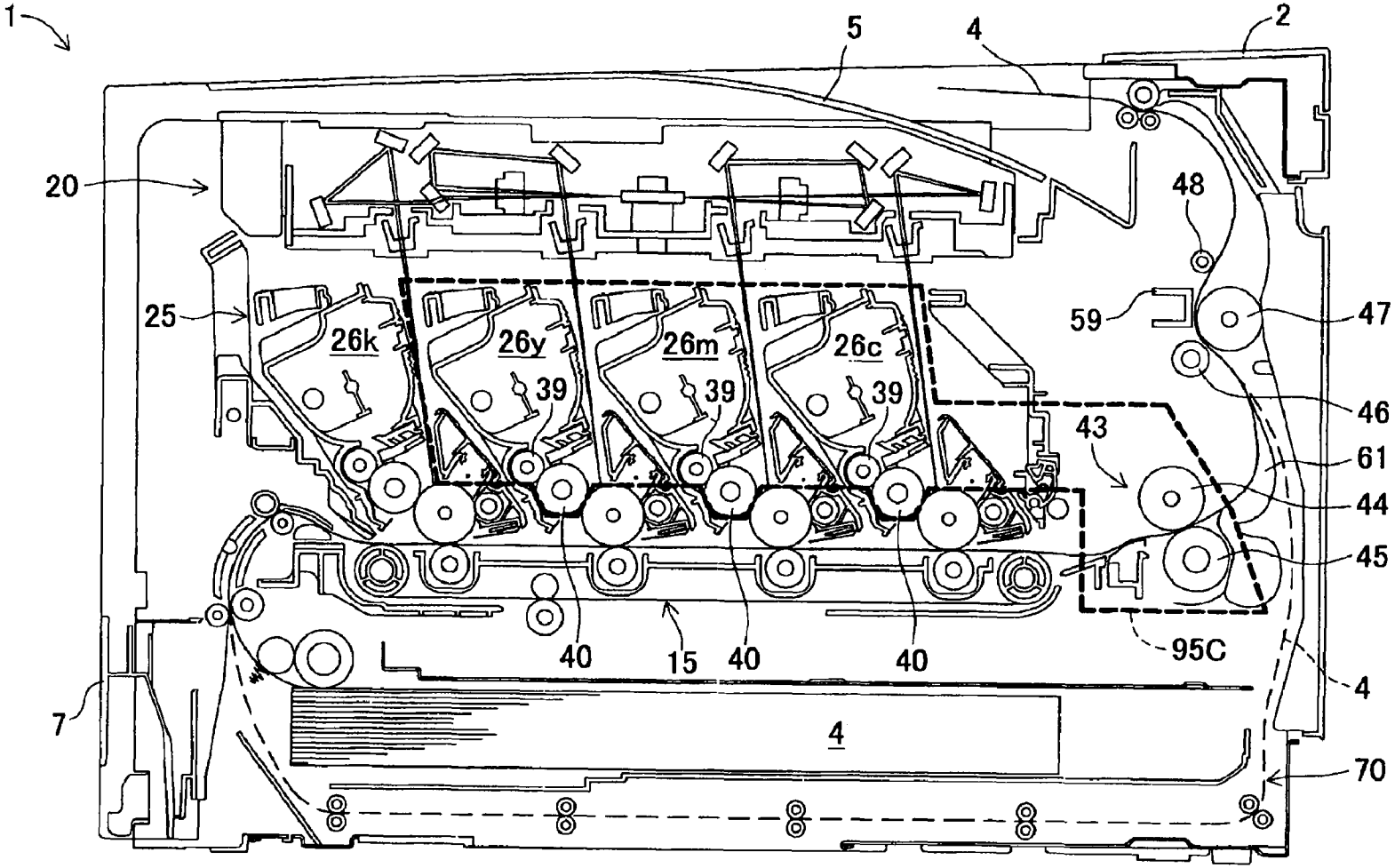
FIG. 5 is an explanatory view showing a third drive-target area in the laser printer.

The third driving portion 90C corresponds to the driving portion that follows the driving of the third motor 60B, and drives respective portions belonging to a third drive-target area 95C (see FIG. 5). As shown in FIG. 5, the third drive target area 95C contains the supply roller 39 and the develop roller 40 of the second image forming unit 26*y*, the supply roller 39 and the develop roller 40 of the third image forming unit 26*m*, the supply roller 39 and the develop roller 40 of the fourth image forming unit 26*c*, and the heat roller 44 and the pressure roller 45 constituting the fixing unit 43. Therefore, in the third driving portion 90C, the third motor controlling portion 86C executes the driving control of the supply roller 39 and the develop roller 40 of the second image forming unit 26*y*, the supply roller 39 and the develop roller 40 of the third image forming unit 26*m*, the supply roller 39 and the develop roller 40 of the fourth image forming unit 26*c*, and the heat roller 44 and the pressure roller 45 constituting the fixing unit 43 by executing the driving control of the third motor 60C.

The fourth motor controlling portion 86D feeds a drive pulse to a fourth motor 60D based on the control signal from the CPU 81, and executes the driving control of the fourth motor 60D. The fourth motor 60D is one of driving sources in the printing by the laser printer 1, and is constructed by a stepping motor. The fourth motor controlling portion 86D as well as the fourth motor 60D constitutes a fourth driving portion 90D.

Figure 6:
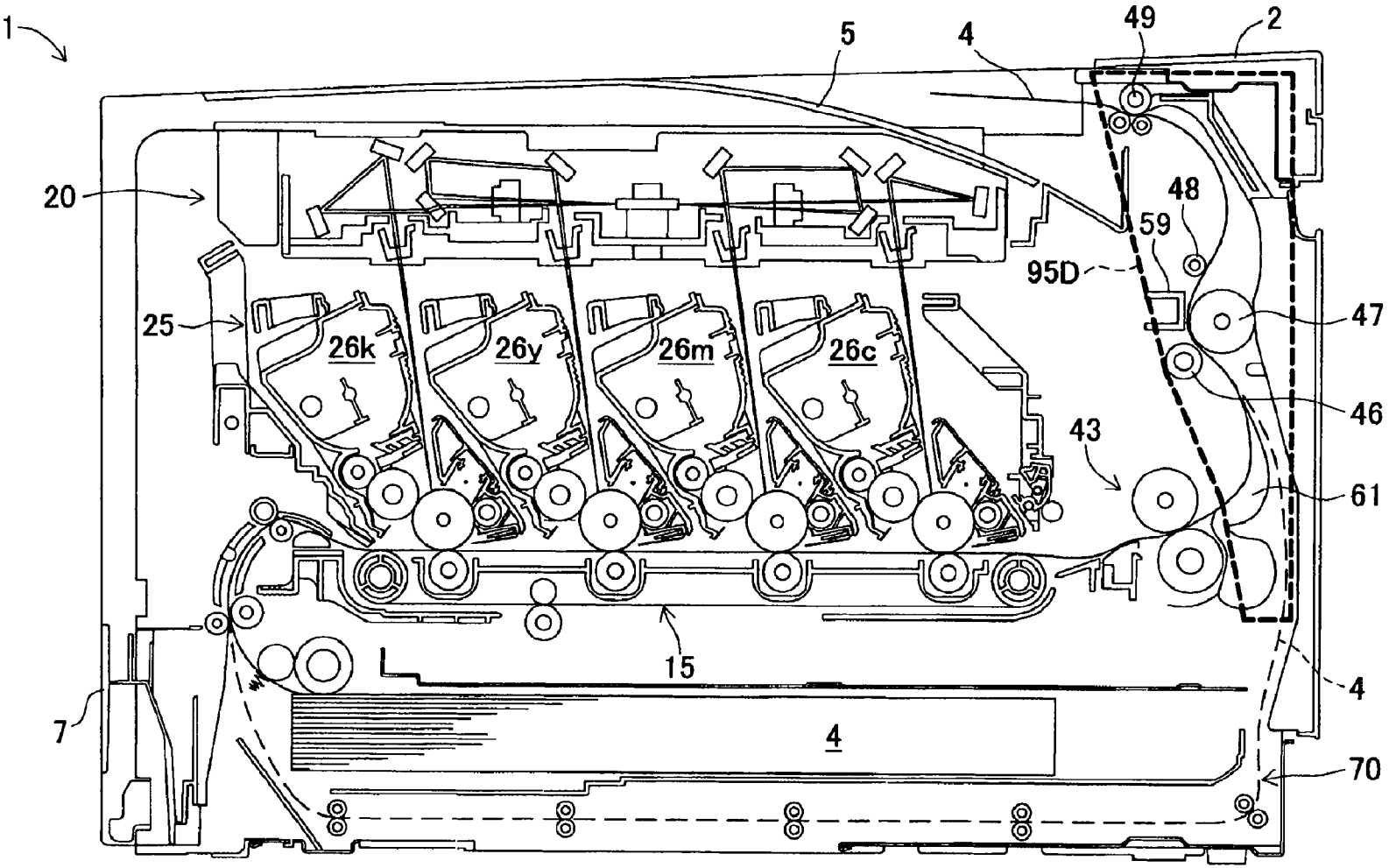
FIG. 6 is an explanatory view showing a fourth drive-target area in the laser printer.

The fourth driving portion 90D corresponds to the driving portion that follows the driving of the fourth motor 60D, and drives respective portions belonging to a fourth drive-target area 95D (see FIG. 6). As shown in FIG. 6, the fourth drive-target area 95D contains the intermediate paper eject roller 46, the paper cool roller 47, and the paper eject roller 49. Therefore, in the fourth driving portion 90C, the fourth motor controlling portion 86D executes the driving control of the intermediate paper eject roller 46, the paper cool roller 47, and the paper eject roller 49 by executing the driving control of the fourth motor 60D.

As described above, since the laser printer 1 includes independently the first driving portion 90A to the fourth driving portion 90D respectively, such laser printer 1 can execute the driving control of a plurality of driving portions (for example, the first driving portion 90A and the fourth driving portion 90D) independently.

The controlling portion 80 is connected to the above paper feed sensor 57 and the paper sensor 58 respectively. Therefore, the CPU 81 can execute the printing control (in particular, the conveyance control of the paper 4) in response to the sensed results of the paper feed sensor 57 and the paper sensor 58.

Next, a control program with regard to the continuous double-side printing in the laser printer 1 will be explained in detail with reference to FIG. 7 hereunder. The "continuous double-side printing" denotes that the user's desired printing should be applied to both the front and back surfaces of plural sheets of paper 4. In the following explanation, it is assumed that the continuous double-side printing is done on two sheets of paper, wherein the paper 4 serving as the processed object in first sheet is referred to as the "preceding paper 4A" and the paper 4 serving as the processed object in second sheet is referred to as the "following paper 4B". The surface that acts as the printed object precedingly out of the papers 4 that are the object of the double-side printing is mentioned as the "first surface", and the surface that acts as the printed object succeedingly and positioned on the back surface of the first surface is mentioned as the "second surface".

Figure 7:
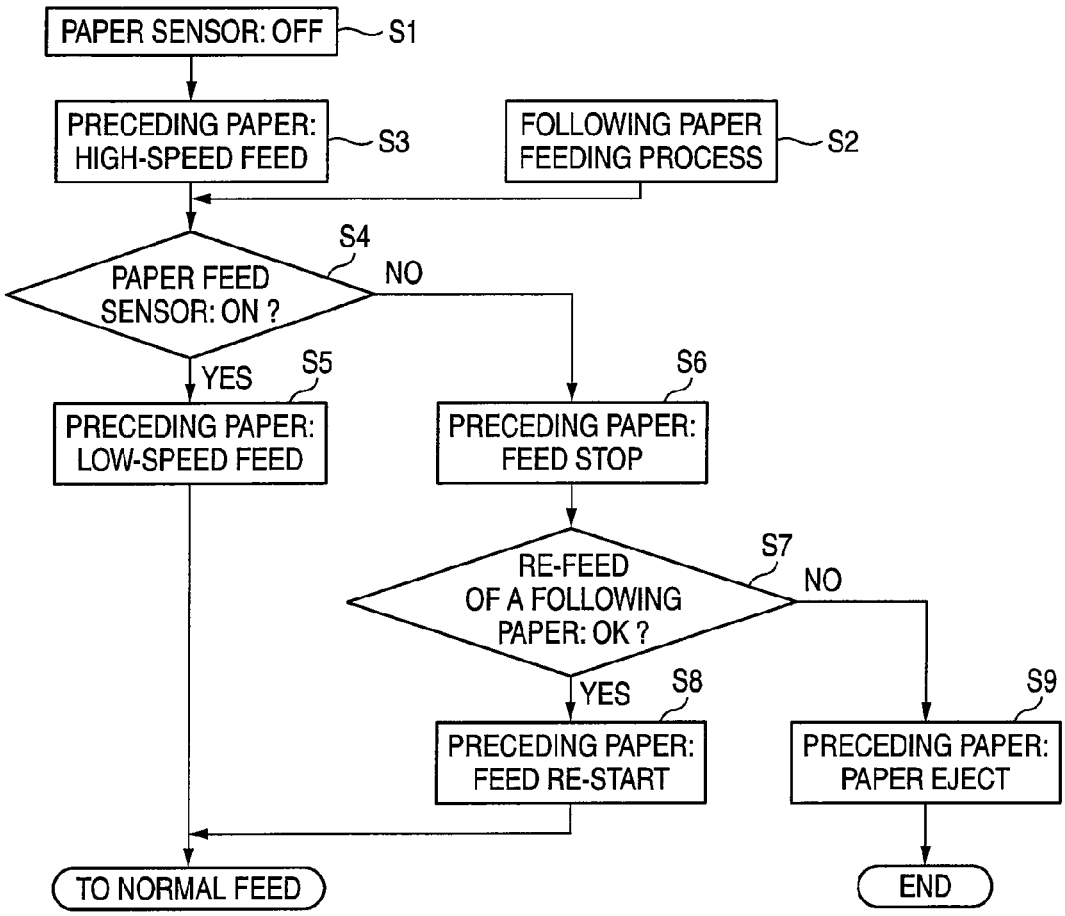
FIG. 7 is a flowchart of a control program with regard to the continuous double-side printing.

The control program in FIG. 7 is executed in a predetermined stage in the continuous double-side printing after the printing on the first surface of the preceding paper 4A is ended. Concretely, the CPU 81 executes this control program in the stage that the preceding paper 4A, on the first surface of which the image is formed, passes through the fixing unit 43 and is conveyed into the sensing range of the paper sensor 58. It can be detected based on the number of revolution of the third motor 60C of the third driving portion 90C, for example, that the preceding paper 4A is conveyed in the sensing range of the paper sensor 58.

When the continuous double-side printing is started, the CPU 81 executes the driving control of the first motor 60A so as to feed the preceding paper 4A from the paper feed cassette 7 and convey this paper to the register rollers 13 and the image forming portion 26. Then, the CPU 81 executes the driving controls of the first motor 60A to the third motor 60C to form the image on the first surface of the preceding paper 4A by the image forming portion 85 while conveying the preceding paper 4A. The preceding paper 4A, on the first surface of which the image is formed, is conveyed to the fixing unit 43 according to the driving control of the third motor 60C.

Then, the image is fixed on the first surface by the fixing unit 43, and then the CPU 81 executes the driving control of the third motor 60C to convey the preceding paper 4A toward the intermediate paper eject roller 46 and the paper cool roller 47. Then, the preceding paper 4A is held between the intermediate paper eject roller 46 and the paper cool roller 47, and then the CPU 81 executes the driving control of the fourth motor 60D to convey the preceding paper 4A toward the paper eject tray 5 at the conveyance velocity V. In this stage, the preceding paper 4A is positioned in the sensing range of the paper sensor 58. Therefore, the paper sensor 58 transmits an ON signal to the controlling portion 80.

Figure 8:
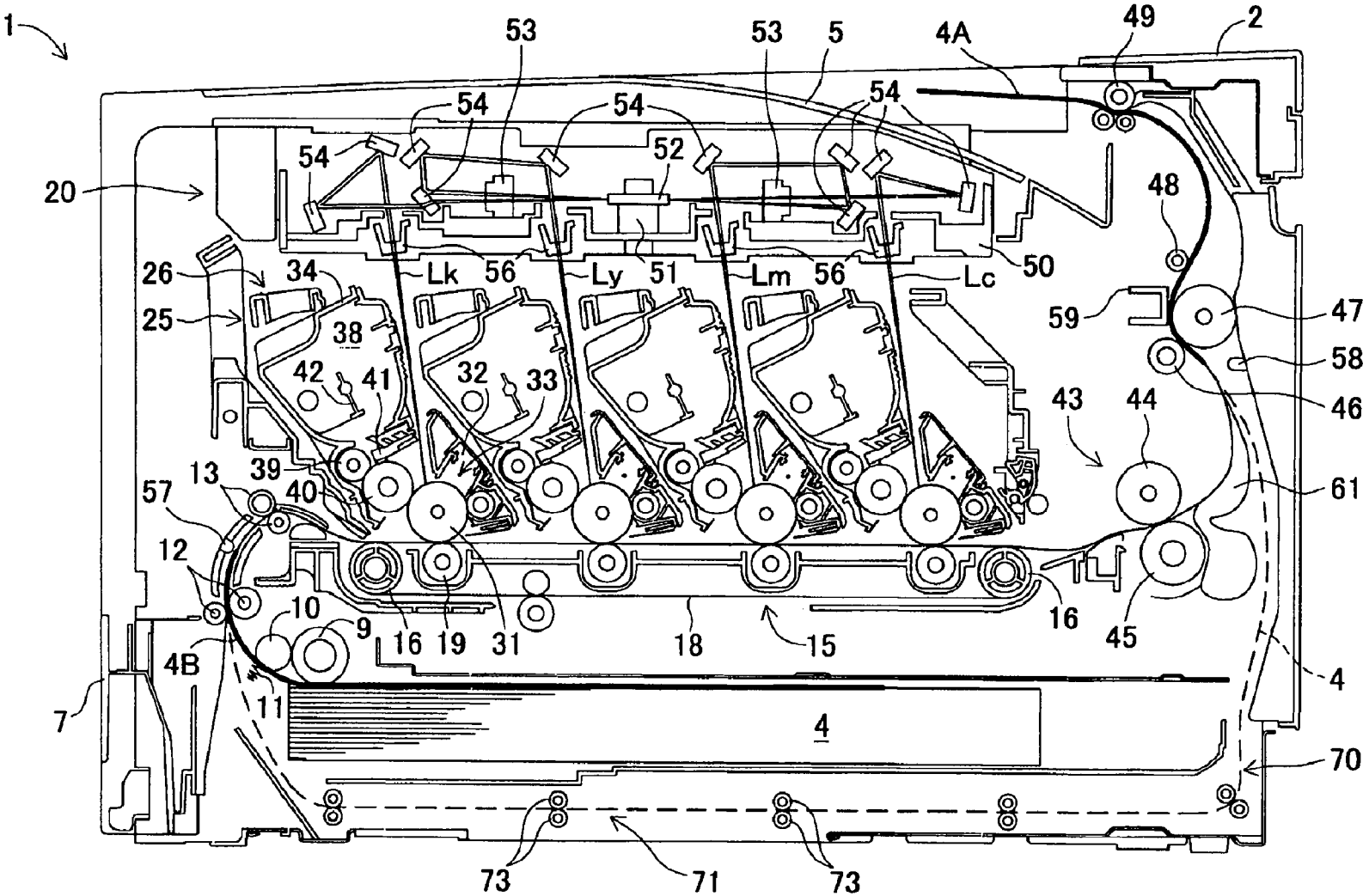
FIG. 8 is an explanatory view (1) showing a state of continuous double-side printing.

When the execution of the control program shown in FIG. 7 is started as soon as the preceding paper 4A is conveyed to the sensing range of the paper sensor 58, the CPU 81 confirms that the paper sensor 58 is in its OFF (S1). That is, as shown in FIG. 8, the CPU 81 confirms the state that the rear end of the preceding paper 4A has passed through the sensing range of the paper sensor 58. If the paper sensor 58 is not in its OFF state, the CPU 81 causes to convey the preceding paper 4A toward the paper eject tray 5 at the conveyance velocity V until the paper sensor 58 goes to its OFF state. In contrast, if the CPU 81 confirmed the OFF state of the paper sensor 58, such CPU 81 causes the process to go to S3.

In the stage that the rear end of the preceding paper 4A has passed through the sensing range of the paper sensor 58, the CPU 81 executes a following paper feeding process such that a predetermined interval is formed between the preceding paper 4A and the following paper 4B (S2). As a result, the following paper 4B is fed from the paper feed cassette 7 at a timing that a predetermined interval (e.g., 429.08 mm (or more)) is kept from the preceding paper 4A. Then, in the following paper feeding process (S2), the CPU 81 executes the driving control of the first motor 60A to rotate/drive the paper feed roller 9, etc. As a result, the following paper 4B is fed from the paper feed cassette 7, and is conveyed toward the register rollers 13.

Here, the process in S1 concerning the preceding paper 4A and the process in S2 concerning the following paper 4B are the independent processes that are carried out by the driving of the separate driving portions. Therefore, the process in S1 and the process in S2 can be executed in parallel at the same time, based on the command from the CPU 81.

When the preceding paper 4A is conveyed toward the paper eject tray 5 until the paper sensor 58 goes to its OFF state (the position of the preceding paper 4A in FIG. 8), the CPU 81 causes to convey the preceding paper 4A in a switchback mode. That is, the CPU 81 executes the driving control of the fourth motor 60D to reverse the conveyance direction of the preceding paper 4A by rotating the intermediate paper eject roller 46, etc. in the backward direction. Accordingly, the preceding paper 4A is conveyed toward the re-conveyance mechanism 70. At this time, the CPU 81 executes the driving control of the fourth motor 60D to convey the preceding paper 4A in the switchback mode at a predetermined high-speed re-conveyance velocity R (S3). The high-speed re-conveyance velocity R is set to 1.8 times of the conveyance velocity V.

While the process in S3 is executed, the feeding/conveyance of the following paper 4B are executed continuously. When the feeding of the following paper 4B is carried out normally, the CPU 81 executes the driving control of the first motor 60A to convey the following paper 4B toward the register rollers 13.

Then, in S4, the CPU 81 decides whether or not this CPU receives an ON signal from the paper feed sensor 57. The ON signal of the paper feed sensor 57 means that the paper 4 exists in the sensing range of the paper feed sensor 57. That is, the CPU 81 decides whether or not the paper feeding of the following paper 4B is executed normally and the following paper 4B is conveyed to the vicinity of the register rollers 13. If the paper feed sensor 57 is in its ON state (S4: YES), the CPU 81 shifts the process to S5. In contrast, if the paper feed sensor 57 does not go to its ON state (S4: NO) even though the first motor 60A is driven sufficiently such that the following paper 4B reaches the paper feed sensor 57, the CPU 81 shifts the process to S6. In this case, the case where "the paper feed sensor 57 does not go to its ON state" contains the case where an error occurs in the feeding of the preceding paper 4A due to the idle running of the paper feed roller 9, and the like.

Even when the deciding process in S4 is being executed, the preceding paper 4A is still conveyed by the fourth driving portion 90D at the high-speed re-conveyance velocity R in the switchback mode. This high-speed re-conveyance velocity R is set in such a manner that the preceding paper 4A is located in the higher position than the preceding paper 4A in FIG. 9 not to pass through the driving range of the fourth driving portion 90D.

In S5, the CPU 81 causes to convey the preceding paper 4A, which is being conveyed at the high-speed re-conveyance velocity R in the switchback mode, at a low speed. That is, the CPU 81 continues to convey the preceding paper 4A in the switchback mode while lowering the re-conveyance velocity of the preceding paper 4A from the high-speed re-conveyance velocity R to a normal re-conveyance velocity S by a predetermined deceleration (i.e., a negative acceleration). Here, the normal re-conveyance velocity S is set to 1.05 times of the above conveyance velocity V, for example. The preceding paper 4A is positioned in the neighborhood of the boundary between the fourth drive target area 95D and the first drive-target area 95A (see FIG. 9) at a time when the conveyance velocity V is lowered to the normal re-conveyance velocity S.

Figure 9:
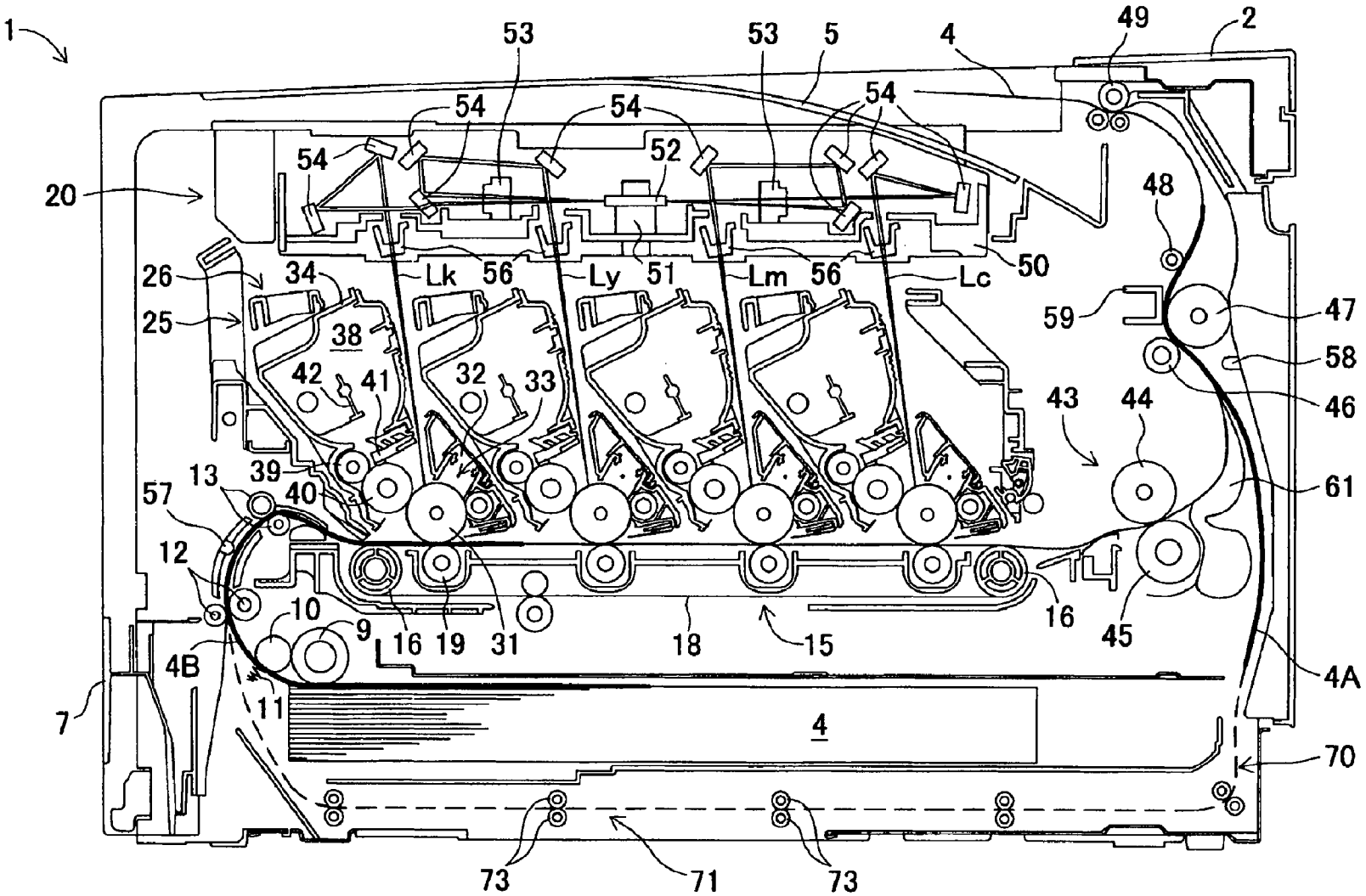
FIG. 9 is an explanatory view (2) showing a state of continuous double-side printing.
Figure 10:
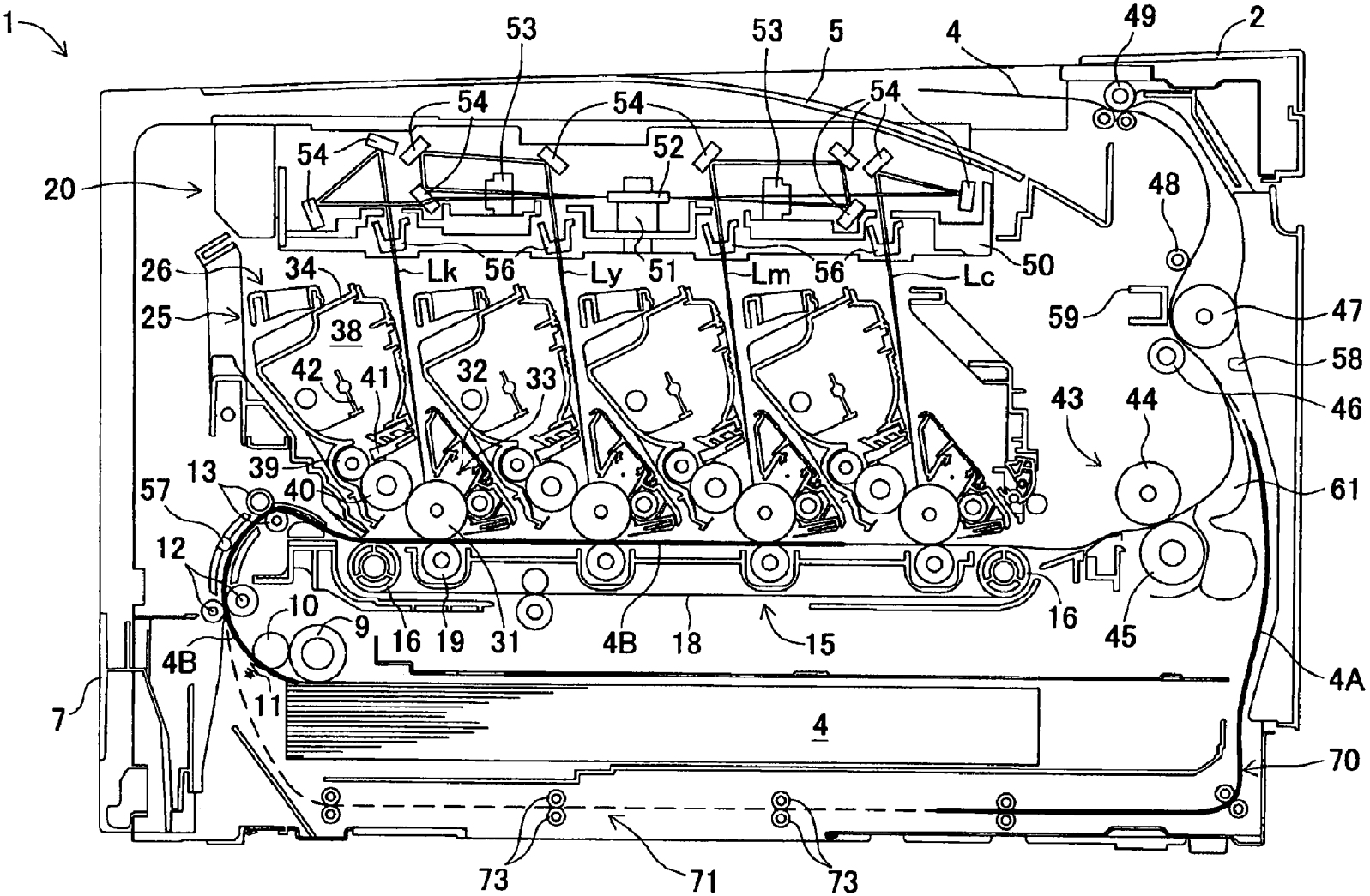
FIG. 10 is an explanatory view (3) showing a state of continuous double-side printing.

When the preceding paper 4A is conveyed to the position shown in FIG. 9 in the switchback mode while lowering the conveyance velocity V to the normal re-conveyance velocity S, the CPU 81 executes the normal conveyance of the preceding paper 4A. That is, the CPU 81 executes the driving control of the first motor 60A to convey the preceding paper 4A toward the register rollers 13 and the belt unit 15 via the re-conveyance path 71 (see FIG. 10). The conveyance velocity of the preceding paper 4A on the re-conveyance path 71 is equal to the above conveyance velocity V. Therefore, the CPU 81 executes the driving control of the first motor 60A to control the rotation/driving of the re-conveyance rollers 73 such that the preceding paper 4A is conveyed on the re-conveyance path 71 at the conveyance velocity V.

At this time, the following paper 4B fed in S2 is conveyed to the belt unit 15 at the equal velocity to the conveyance velocity V, according to the driving control of the first motor 60A. Then, when the following paper 4B reaches the belt unit 15, the CPU 81 executes the driving control of the second motor 60B and the third motor 60C to convey the following paper 4B while keeping the velocity (i.e., at the conveyance velocity V) and execute the image forming process.

As described above, the conveyance velocity of the preceding paper 4A is changed from the normal re-conveyance velocity S to the conveyance velocity V while the preceding paper 4A is moved from the fourth drive target area 95D to the first drive target area 95A. At this time, the normal re-conveyance velocity S is slightly higher than the conveyance velocity on the re-conveyance path 71. Because such velocity difference is provided between both velocities, the preceding paper 4A is never pulled simultaneously by both the first driving portion 90A and the fourth driving portion 90D. In other words, even when the conveyance velocity is lowered from the high-speed re-conveyance velocity R in the conveyance path in the fourth drive target area 95D, such conveyance velocity is lowered to the normal re-conveyance velocity S that has a velocity difference from the ordinary conveyance velocity V, so that the laser printer 1 can perform smoothly the high-speed conveyance not to impose a burden on the paper 4. Accordingly, the speedup of the double-side printing can be attained. Even if the velocity is decreased lower than the conveyance velocity V (e.g., 0.98 times of the conveyance velocity V) before the first drive target area 95A during the speed decreasing operation, the conveyance velocity V of the first driving portion 90A becomes larger than the conveyance velocity of the fourth driving portion 90D. While the preceding paper 4A is moved from the fourth drive target area 95D to the first drive target area 95A, this paper is pulled on account of this velocity difference. As a result, it is possible that the paper 4 is broken or the paper jam is caused.

Then, when the preceding paper 4A being conveyed in the switchback mode reaches the belt unit 15, the second surface of the preceding paper 4A is brought into the state to face to the processing portion 25. As a result, when the preceding paper 4A is conveyed in this state and the image formation is applied, the laser printer 1 can do the double-side printing on the preceding paper 4A.

In contrast, when the process goes to S6 under the condition that the feeding of the following paper 4B is not normally executed, the CPU 81 executes the driving control of the fourth motor 60D to stop the conveyance of the preceding paper 4A in the switchback mode. At this time, the preceding paper 4A is held by the intermediate paper eject roller 46, the paper cool roller 47, and the like such that this paper is located between the position shown in FIG. 8 and the position shown in FIG. 9. After the conveyance of the preceding paper 4A in the switchback mode is stopped, the CPU 81 shifts the process to S7.

In S6, the CPU 81 executes the driving control of the first motor 60A at predetermined timings (e.g., at timings between which an interval between the preceding paper 4A and the following paper 4B has a predetermined interval (461.08 mm)) to feed again the following paper 4B. At this time, the driving control of the fourth motor 60D regarding the conveyance stop of the preceding paper 4A and the driving control of the first motor 60A regarding the re-feeding of the following paper 4B are independently executed respectively.

In S7, the CPU 81 decides whether or not the re-feeding of the following paper 4B is done normally. Concretely, the CPU 81 executes the deciding process in S7, based on the sensing signal of the paper feed sensor 57. If the re-feeding of the following paper 4B is done normally (S7: YES), the CPU 81 shifts the process to S8. In contrast, if an error occurs in the re-feeding of the following paper 4B (S7: NO), the CPU 81 shifts the process to S9.

In S8, the CPU 81 executes the driving control of the fourth motor 60D to restart the conveyance of the preceding paper 4A in the switchback mode. Therefore, as shown in FIG. 8 and FIG. 9, the conveyance velocity is switched to the high-speed conveyance, and then the preceding paper 4A is conveyed toward the register rollers 13 and the belt unit 15 via the re-conveyance path 71. In this case, the conveyance velocity of the preceding paper 4A is also restored to the normal re-conveyance velocity S at a point of time the preceding paper 4A reaches the boundary between the fourth drive target area 95D and the first drive target area 95A. Then, like the case in S5, the CPU 81 causes to execute the normal conveyance.

In this event, the following paper 4B is conveyed independently of the conveyance of the preceding paper 4A. That is, the preceding paper 4A is conveyed toward the register rollers 13 and the belt unit 15 via the re-conveyance path 71 under the driving control of the fourth motor 60D and the first motor 60A by the controlling portion 80. In parallel with this conveyance of the preceding paper 4A in the switchback mode, the CPU 81 executes the driving control of the image forming portion 85, the second motor 60B, and the third motor 60C to apply the printing process to the first surface of the following paper 4B.

In S9, the CPU 81 executes the driving control of the fourth motor 60D to convey the preceding paper 4A at the conveyance velocity V and eject the preceding paper 4A onto the paper eject tray 5. Concretely, the CPU 81 executes the driving control of the fourth motor 60D to drive the intermediate paper eject roller 46, and the like at the forward rotation. As a result, the preceding paper 4A is conveyed toward the paper eject tray 5 and ejected onto the paper eject tray 5.

As soon as the process in S9 is ended, the CPU 81 ends the process concerning the continuous double-side printing. This is because the preceding paper 4A is ejected onto the paper eject tray 5 without the feeding of the following paper 4B.

In this case, such a configuration informing the effect that an error occurs in the paper feeding of the following paper 4B may also be employed. For example, such a configuration displaying the effect that an error occurs on a display device (i.e., a liquid crystal display, or the like) provided to the laser printer 1 may also be employed. As a method of notifying the error, not only the notification given by the display but also the notification given by the sound may be employed.

In the above explanation, the case where both the conveyance of the preceding paper 4A, on the first surface of which the image is printed, in the switchback mode and the conveyance of the following paper 4B to print the image on the first surface are executed in parallel is explained in detail. In this respect, the similar processes to those in the above explanation may be applied to both the conveyance of the preceding paper 4A to print the image on the second surface and the conveyance of the following paper 4B, on the first surface of which the image is printed, in the switchback mode. Therefore, the explanation about the processed contents in this case is omitted herein.

Then, while the printing process is executed on the second surface of the following paper 4B, the preceding paper 4A, on the first surface and the second surface of which the printing is done, is ejected onto the paper eject tray 5 according to the driving control of the fourth motor 60D. Then, the following paper 4B, on the first surface and the second surface of which the printing is done, is also ejected onto the paper eject tray 5 according to the driving control of the fourth motor 60D. As a result, the laser printer 1 can eject the preceding paper 4A and the following paper 4B, to which the continuous double-side printing is applied, onto the paper eject tray 5, and thus can apply the continuous double-side printing to plural sheets of papers 4.

With the above, as explained above, according to the laser printer 1 of the exemplary embodiment, the paper 4 on one surface of which the printing is done is conveyed by the intermediate paper eject roller 46, etc. in the switchback mode, and thus the double-side printing of the paper 4 can be executed. When the continuous double-side printing is to be done, the laser printer 1 feeds the following paper 4B at a timing at which a predetermined interval is formed between the preceding paper 4A and the following paper 4B (S2). The laser printer 1 is equipped with the first driving portion 90A to the fourth driving portion 90D, which can be controlled independently respectively (see FIG. 2). As a result, the laser printer 1 can control independently both the printing/conveyance processes of the preceding paper 4A and the printing/conveyance processes of the following paper 4B.

Then, the laser printer 1 conveys the preceding paper 4A toward the re-conveyance path 71 at the high-speed re-conveyance velocity R that is higher than the conveyance velocity V, at the time when the preceding paper 4A is to be conveyed in the switchback mode by executing the driving control of the fourth motor 60D. Therefore, the laser printer 1 can shorten a required time for the double-side printing on the preceding paper 4A.

After the preceding paper 4A is conveyed at the high-speed re-conveyance velocity R in the switchback mode, the laser printer 1 conveys the preceding paper 4A while reducing the conveyance velocity of the preceding paper 4A at a predetermined timing by a predetermined deceleration. Then, the laser printer 1 executes the driving control of the fourth motor 60D to get the normal re-conveyance velocity S at a point of time that the preceding paper 4A reaches the first drive target area 95A, and conveys the preceding paper 4A toward the re-conveyance path 71. Therefore, a large velocity difference is never generated while the paper is moved from the fourth driving portion 90D to the first driving portion 90A, and thus the laser printer 1 can transfer the preceding paper 4A smoothly to the first driving portion 90A. As a result, the laser printer 1 can prevent a reduction of printing quality of the paper 4 and a conveyance error of the paper 4 (for example, a paper jam, etc. of the paper 4).

Then, the laser printer 1 can execute in parallel both the control regarding the switchback conveyance of the preceding paper 4A and the control regarding the printing/conveyance of the following paper 4B (see FIG. 7 to FIG. 10). Therefore, when the double-side printing that is applied to plural sheets of paper 4 (the continuous double-side printing) is executed, a time required until all results of user's desired double-side printing are acquired can be shortened. That is, the laser printer 1 can process the continuous double-side printing at a high speed.

When the laser printer 1 conveys the preceding paper 4A, such laser printer 1 executes the conveyance control of the preceding paper 4A in the fourth driving portion 90D while using separately three types of conveyance velocities, i.e., the conveyance velocity V, the high-speed re-conveyance velocity R, and the normal re-conveyance velocity S, appropriately. As a result, the laser printer 1 can implement with good precision the processes that are associated with the higher speed of the continuous double-side printing.

Further, when the continuous double-side printing is done in the laser printer 1, the paper 4 is conveyed over the path extending from the eject port to the paper eject tray 5 to the bottom end of the paper cool roller 47 in both the case where the paper 4 is discharged onto the paper eject tray 5 and the case where the paper 4 is conveyed toward the re-conveyance path 71 in the switchback mode. Under the control made based on the control program shown in FIG. 7, the laser printer 1 conveys the preceding paper 4A to the re-conveyance path 71 before the following paper 4B is conveyed to the neighborhood of the paper cool roller 47. As a result, the laser printer 1 can prevent such a situation that the preceding paper 4A and the following paper 4B interfere with each other on the conveyance path, and can implement the continuous double-side printing smoothly at a high speed.

Then, the laser printer 1 feeds the following paper 4B from the paper feed cassette 7 while conveying the preceding paper 4A in the switchback mode (S2). The laser printer 1 decides whether or not the feeding of the following paper 4B was normally done, based on the detected result of the paper feed sensor 57 (S4). If such feeding was not normally done, the CPU 81 stops the conveyance of the preceding paper 4A in the switchback mode (S6). Therefore, the laser printer 1 can prevent such a situation that the preceding paper 4A and the following paper 4B collide with each other on the conveyance path and such a situation that the processing order of the preceding paper 4A and the following paper 4B is changed. As a result, the laser printer 1 can execute the continuous double-side printing on plural sheets of paper 4 without fail in a user's desired mode.

Further, the laser printer 1 drives the first motor 60A to the third motor 60C such that the re-conveyance rollers 73 provided on the re-conveyance path 71, the paper feed roller 9, the register rollers 13, and the like are driven to convey the preceding paper 4A at the conveyance velocity V. Therefore, the paper 4 that is conveyed in the switchback mode is conveyed at a constant conveyance velocity (i.e., the conveyance velocity V) while being conveyed through the register rollers 13 and the belt unit 15 via the re-conveyance path 71. That is, since the laser printer 1 conveys the paper 4 at a constant conveyance velocity from the re-conveyance path 71 to the belt unit 15, this laser printer 1 can carry out the double-side printing smoothly at a high speed.

In the laser printer 1, the first motor 60A to the fourth motor 60D are constructed by a stepping motor respectively. The stepping motor is rotated by an angle that is proportional to the number of input pulses, and is rotated at a rotation speed that is proportional to the frequency of input pulses. Therefore, the laser printer 1 can execute the control of conveyance velocity in the first driving portion 90A to the fourth driving portion 90D with good precision by using a simple control system.

With the above, the present invention is explained with reference to the embodiment, but the present invention is not limited to the above embodiment at all. Various variations and improvements can be applied within a scope that does not depart from a gist of the present invention. For example, in the exemplary embodiment, the continuous double-side printing applied to two sheets of paper 4 is explained, but the present invention is not limited to this mode. That is, the present invention can be applied to the continuous double-side printing applied to a great many of papers 4.

In the exemplary embodiment, a magnitude relation between the conveyance velocity V, the high-speed re-conveyance velocity R, and the normal re-conveyance velocity S is given as a mere example, and these magnitudes of velocities can be changed appropriately. The conveyance velocity used as a standard is not limited to the conveyance velocity V in the exemplary embodiment if such magnitude relation between the conveyance velocity V, the high-speed re-conveyance velocity R, and the normal re-conveyance velocity S can be specified.

When an error occurs during the re-feeding of the preceding paper 4A in a state that the printing on the first surface of the preceding paper 4A is ended, the exemplary embodiment is constructed to eject the preceding paper 4A (S9). But the exemplary embodiment is not limited to this mode. For example, the present invention can be constructed to do the printing on the second surface of the preceding paper 4A not to execute the re-feeding of the following paper 4B. According to this mode, the user cannot obtain the printing result concerning the following paper 4B, nevertheless the user can get the preceding paper 4A to which the desired double-side printing is applied.

FIG. 2:
(1) scanner unit 20
(2) processing portion 25
(3) fixing unit 43
(4) image forming portion 85
(5) paper feed sensor 57
(6) paper sensor 58
(7) first motor 60A
(8) second motor 60B
(9) third motor 60C
(10) fourth motor 60D
(11) controlling portion 80
(12) image formation controlling portion 84
(13) first motor controlling portion 86A
(14) second motor controlling portion 86B
(15) third motor controlling portion 86C
(16) fourth motor controlling portion 86D FIG. 7:
(1) paper sensor: OFF (S1)
(2) following paper feeding process (S2)
(3) preceding paper: high-speed feed (S3)
(4) paper feed sensor: ON? (S4)
(5) preceding paper: low-speed feed (S5)
(6) preceding paper: feed stop (S6)
(7) re-feed of a following paper: OK? (S7)
(8) preceding paper: feed re-start (S8)
(9) preceding paper: paper eject (S9)
(10) to normal feed

What is claimed is:

1. An image forming apparatus capable of performing single-side and double-side printing on a recording sheet, comprising:

a conveyance path;

an image forming unit configured to form an image on the recording sheet which is passing through the conveyance path;

a fixing unit configured to fix the image being formed by the image forming unit on the recording sheet;

a backward conveyance path configured to guide the recording sheet, on which the is image formed on one surface thereof, toward the image forming unit to form the image on the other surface of the recording sheet;

a feeder configured to feed the recording sheet at a timing at which a predetermined interval is formed between plural recording sheets respectively such that the recording sheets are present on the conveyance path and/or the backward conveyance path;

a first conveyance unit configured to convey the recording sheet selectively in an eject mode or in a switchback conveyance mode, wherein in the eject mode, the recording sheet on which the image is fixed is ejected to an outside of the apparatus on a downstream side of the fixing unit in a conveyance direction of the recording sheet, and wherein in the switchback conveyance mode, the conveyance direction of the recording sheet in which the image is formed on one surface thereof is switched backward on the downstream side of the fixing unit and then the recording sheet is conveyed toward the backward conveyance path;

a first driver configured to drive the first conveyance unit;

a second conveyance unit configured to convey the recording sheet, which is conveyed by the first conveyance unit in the switchback conveyance mode toward the backward conveyance path, to the image forming unit through the backward conveyance path;

a second driver configured to drive the second conveyance unit; and a drive controller configured to:

control the first driver such that a conveyance velocity of the recording sheet conveyed by the first conveyance unit in the eject mode is set to a first conveyance velocity;

control the first driver such that the conveyance velocity of the recording sheet conveyed by the first conveyance unit in the switchback conveyance mode is initially set to a second conveyance velocity that is higher than the first conveyance velocity; and control the first driver such that the conveyance velocity of the recording sheet conveyed by the first conveyance unit in the switchback conveyance mode is set to a third conveyance velocity that is higher than the first conveyance velocity and lower than the second conveyance velocity, before the recording sheet reaches the second conveyance unit.

2. The image forming apparatus according to claim 1, wherein the conveyance path includes a common path through which the recording sheet is conveyed both when the recording sheet is conveyed by the first conveyance unit in the eject mode at the first conveyance velocity and when the recording sheet is conveyed by the first conveyance unit in the switchback conveyance mode at the second conveyance velocity, and the drive controller is configured to control the first driver such that at a point of time just before a following recording sheet on which the image is fixed by the fixing unit enters into the common path, a preceding recording sheet, which is positioned at the predetermined interval downstream of the following recording sheet, is conveyed by the first conveyance unit in the switchback conveyance mode at the second conveyance velocity out of the common path.

3. The image forming apparatus according to claim 1, wherein the feeder is configured to feed a following recording sheet subsequent to the preceding recording sheet while the first conveyance unit conveys the preceding recording sheet in the backward conveyance direction in the switchback conveyance mode.

4. The image forming apparatus according to claim 3 further comprising a sensor configured to sense whether or not the following recording sheet is fed normally by the feeder, wherein, when the sensor detects that the following recording sheet is not fed normally, the drive controller stops the conveyance of the preceding recording sheet by the first conveyance unit.

5. The image forming apparatus according to claim 1, wherein the second driver is configured to drive the feeder and the second conveyance unit, the recording sheet which has been conveyed by the first conveyance unit in the switchback conveyance mode is conveyed on the backward conveyance path, and the drive controller is configured to control the second driver such that the recording sheet is conveyed continuously by the second conveyance unit at a fourth conveyance velocity, which is equal to the first conveyance velocity and the conveyance velocity of the recording sheet while the image is formed by the image forming unit.

6. The image forming apparatus according to claim 1, wherein the first driver and the second driver are constructed by a stepping motor respectively.

* * * * *

UNITED STATES PATENT AND TRADEMARK OFFICE

CERTIFICATE OF CORRECTION

PATENT NO. : 8,272,641 B2
APPLICATION NO. : 12/732891
DATED : September 25, 2012
INVENTOR(S) : Yuji Tokoro It is certified that error appears in the above-identified patent and that said Letters Patent is hereby corrected as shown below:

In the Claims:

Column 18, Claim 1, Lines 4-5:
Please delete "ejected to an outside" and insert --ejected outside--

Signed and Sealed this
Eleventh Day of June, 2013

Teresa Stanek Rea
*Acting Director of the United States Patent and Trademark Office*